US009099825B2

(12) United States Patent
Wild et al.

(10) Patent No.: US 9,099,825 B2
(45) Date of Patent: Aug. 4, 2015

(54) CENTER CONDUCTOR ENGAGEMENT MECHANISM

(71) Applicant: John Mezzalingua Associates, Inc., East Syracuse, NY (US)

(72) Inventors: Werner K. Wild, Buttenwiesen (DE); Noah Montena, Syracuse, NY (US); Christopher P. Natoli, Fulton, NY (US); Adam T. Nugent, Canastota, NY (US)

(73) Assignee: John Mezzalingua Associates, LLC, Liverpool, NY (US)

( * ) Notice: Subject to any disclaimer, the term of this patent is extended or adjusted under 35 U.S.C. 154(b) by 150 days.

(21) Appl. No.: 13/738,363

(22) Filed: Jan. 10, 2013

(65) Prior Publication Data

US 2013/0183856 A1 Jul. 18, 2013

Related U.S. Application Data

(60) Provisional application No. 61/585,871, filed on Jan. 12, 2012.

(51) Int. Cl.
*H01R 9/05* (2006.01)
*H01R 24/38* (2011.01)
*H01R 24/56* (2011.01)

(52) U.S. Cl.
CPC ..... *H01R 24/38* (2013.01); *H01R 24/564* (2013.01); *H01R 24/566* (2013.01); *H01R 9/0521* (2013.01)

(58) Field of Classification Search
USPC ..... 439/578, 585, 584, 950, 620.04
See application file for complete search history.

(56) References Cited

U.S. PATENT DOCUMENTS

| | | | |
|---|---|---|---|
| 3,764,959 | A | 10/1973 | Toma et al. |
| 3,910,673 | A | 10/1975 | Stokes |
| 4,531,805 | A | 7/1985 | Werth |
| 4,579,415 | A | 4/1986 | Van Brunt et al. |
| 4,676,577 | A | 6/1987 | Szegda |
| 4,808,128 | A | 2/1989 | Werth |
| 4,952,174 | A | 8/1990 | Sucht et al. |
| 5,137,470 | A | 8/1992 | Doles |
| 5,167,533 | A | 12/1992 | Rauwolf |
| 5,199,894 | A | 4/1993 | Kalny et al. |
| 5,322,454 | A | 6/1994 | Thommen |
| 5,393,244 | A | 2/1995 | Szegda |

(Continued)

FOREIGN PATENT DOCUMENTS

| | | | |
|---|---|---|---|
| DE | 4344328 | C1 | 1/1995 |
| EP | 1858123 | A2 | 11/2007 |

(Continued)

OTHER PUBLICATIONS

PCT/US2013/021147 Date of mailing: Mar. 13, 2013 International Search Report and Written Opinion. pp. 11.

*Primary Examiner* — Alexander Gilman
(74) *Attorney, Agent, or Firm* — Barclay Damon, LLP

(57) ABSTRACT

A center conductor engagement member comprising a resilient contact region having a first end and a second end, the resilient contact region being substantially curvilinear from the first end to the second end, wherein the second end of the resilient contact region is secured by a body portion, and an insert engageable with the second end of the resilient contact region to retain the second end of the resilient contact region is provided. Furthermore, an associated method is also provided.

19 Claims, 8 Drawing Sheets

(56) References Cited

U.S. PATENT DOCUMENTS

| | | | | |
|---|---|---|---|---|
| 5,397,243 | A | 3/1995 | MacMurdo, Sr. | |
| 5,435,745 | A | 7/1995 | Booth | |
| 5,518,420 | A * | 5/1996 | Pitschi | 439/578 |
| 5,620,339 | A | 4/1997 | Gray et al. | |
| 5,720,630 | A | 2/1998 | Richmond et al. | |
| 5,766,037 | A | 6/1998 | Nelson | |
| 5,863,220 | A | 1/1999 | Holliday | |
| 5,938,474 | A | 8/1999 | Nelson | |
| 5,984,723 | A | 11/1999 | Wild | |
| 6,019,519 | A | 2/2000 | Grinderslev et al. | |
| 6,019,636 | A | 2/2000 | Langham | |
| 6,032,358 | A | 3/2000 | Wild | |
| 6,102,738 | A | 8/2000 | Macek et al. | |
| 6,109,964 | A | 8/2000 | Kooiman | |
| 6,123,567 | A | 9/2000 | McCarthy | |
| 6,133,532 | A | 10/2000 | Lundback et al. | |
| 6,183,298 | B1 | 2/2001 | Henningsen | |
| 6,203,360 | B1 | 3/2001 | Harting et al. | |
| 6,206,579 | B1 | 3/2001 | Selfridge et al. | |
| 6,264,374 | B1 | 7/2001 | Selfridge et al. | |
| 6,267,621 | B1 | 7/2001 | Pitschi et al. | |
| 6,272,738 | B1 | 8/2001 | Holliday et al. | |
| 6,309,251 | B1 | 10/2001 | Tang | |
| 6,331,123 | B1 | 12/2001 | Rodrigues | |
| 6,386,915 | B1 | 5/2002 | Nelson | |
| 6,471,545 | B1 | 10/2002 | Hosler, Sr. | |
| 6,478,618 | B2 | 11/2002 | Wong | |
| 6,494,743 | B1 | 12/2002 | Lamatsch et al. | |
| 6,569,565 | B2 | 5/2003 | Ligeois et al. | |
| 6,607,398 | B2 | 8/2003 | Henningsen | |
| 6,733,336 | B1 | 5/2004 | Montena et al. | |
| 6,840,803 | B2 | 1/2005 | Wlos et al. | |
| 6,860,761 | B2 | 3/2005 | Lee et al. | |
| 6,878,049 | B2 | 4/2005 | Heidelberger et al. | |
| 6,884,113 | B1 | 4/2005 | Montena | |
| 6,884,115 | B2 | 4/2005 | Malloy | |
| 6,926,555 | B2 * | 8/2005 | Nelson | 439/578 |
| 6,939,169 | B2 | 9/2005 | Islam et al. | |
| 6,955,562 | B1 | 10/2005 | Henningsen | |
| 6,976,872 | B1 | 12/2005 | Wild et al. | |
| 7,008,264 | B2 | 3/2006 | Wild | |
| 7,021,965 | B1 | 4/2006 | Montena | |
| 7,029,304 | B2 | 4/2006 | Montena | |
| 7,029,326 | B2 | 4/2006 | Montena | |
| 7,070,447 | B1 | 7/2006 | Montena | |
| 7,077,699 | B2 | 7/2006 | Islam et al. | |
| 7,086,897 | B2 | 8/2006 | Montena | |
| 7,104,839 | B2 | 9/2006 | Henningsen | |
| 7,108,547 | B2 | 9/2006 | Kisling et al. | |
| 7,112,093 | B1 | 9/2006 | Holland | |
| 7,121,883 | B1 | 10/2006 | Petersen et al. | |
| 7,128,603 | B2 | 10/2006 | Burris et al. | |
| 7,131,868 | B2 | 11/2006 | Montena | |
| 7,156,560 | B2 | 1/2007 | Seeley | |
| 7,156,696 | B1 | 1/2007 | Montena | |
| 7,163,420 | B2 | 1/2007 | Montena | |
| 7,179,121 | B1 * | 2/2007 | Burris et al. | 439/578 |
| 7,189,115 | B1 | 3/2007 | Montena | |
| 7,207,838 | B2 | 4/2007 | Andreescu | |
| 7,264,502 | B2 | 9/2007 | Holland | |
| 7,278,854 | B1 | 10/2007 | Robinette et al. | |
| 7,303,435 | B2 | 12/2007 | Burris et al. | |
| 7,309,255 | B2 | 12/2007 | Rodrigues | |
| 7,335,059 | B2 | 2/2008 | Vaccaro | |
| 7,347,729 | B2 | 3/2008 | Thomas et al. | |
| 7,351,101 | B1 | 4/2008 | Montena | |
| 7,357,672 | B2 | 4/2008 | Montena | |
| 7,374,455 | B2 * | 5/2008 | Purdy et al. | 439/578 |
| 7,458,850 | B1 | 12/2008 | Burris et al. | |
| 7,458,851 | B2 | 12/2008 | Montena | |
| 7,488,210 | B1 * | 2/2009 | Burris et al. | 439/578 |
| 7,497,729 | B1 | 3/2009 | Wei | |
| 7,513,722 | B2 | 4/2009 | Greenberg et al. | |
| 7,527,512 | B2 | 5/2009 | Montena | |
| 7,566,243 | B1 | 7/2009 | Hung | |
| 7,588,460 | B2 | 9/2009 | Malloy et al. | |
| 7,632,143 | B1 | 12/2009 | Islam | |
| 7,635,283 | B1 * | 12/2009 | Islam | 439/583 |
| 7,637,774 | B1 | 12/2009 | Vaccaro | |
| 7,806,724 | B2 | 10/2010 | Paynter et al. | |
| 7,819,698 | B2 * | 10/2010 | Islam | 439/607.45 |
| 7,824,215 | B2 | 11/2010 | Islam et al. | |
| 7,857,661 | B1 | 12/2010 | Islam | |
| 7,918,687 | B2 | 4/2011 | Paynter et al. | |
| 7,927,134 | B2 | 4/2011 | Paynter et al. | |
| 7,934,954 | B1 * | 5/2011 | Chawgo et al. | 439/578 |
| 7,993,159 | B2 | 8/2011 | Chawgo | |
| 8,007,314 | B2 | 8/2011 | Chawgo et al. | |
| 8,038,472 | B2 | 10/2011 | Montena et al. | |
| 8,047,870 | B2 | 11/2011 | Clausen | |
| 8,052,465 | B1 * | 11/2011 | Chawgo | 439/578 |
| 8,123,557 | B2 | 2/2012 | Montena et al. | |
| 8,136,236 | B2 | 3/2012 | Amato | |
| 8,177,583 | B2 | 5/2012 | Chawgo et al. | |
| 8,298,006 | B2 | 10/2012 | Wild et al. | |
| 8,388,375 | B2 * | 3/2013 | Chawgo et al. | 439/578 |
| 8,400,318 | B2 * | 3/2013 | Montena | 340/635 |
| 8,419,464 | B2 * | 4/2013 | Montena et al. | 439/489 |
| 8,435,073 | B2 * | 5/2013 | Wild et al. | 439/578 |
| 8,439,703 | B2 * | 5/2013 | Natoli | 439/578 |
| 8,591,253 | B1 * | 11/2013 | Chawgo et al. | 439/578 |
| 8,602,818 | B1 * | 12/2013 | Chawgo et al. | 439/578 |
| 8,747,152 | B2 * | 6/2014 | Van Swearingen et al. | 439/578 |
| 8,773,255 | B2 * | 7/2014 | Montena | 340/535 |
| 2005/0079761 | A1 | 4/2005 | Rodrigues | |
| 2006/0014427 | A1 | 1/2006 | Islam et al. | |
| 2006/0134979 | A1 | 6/2006 | Henningsen | |
| 2006/0199431 | A1 | 9/2006 | Paynter | |
| 2006/0246774 | A1 | 11/2006 | Buck | |
| 2007/0149047 | A1 | 6/2007 | Wild et al. | |
| 2007/0270032 | A1 | 11/2007 | Eriksen | |
| 2008/0003873 | A1 | 1/2008 | Henningsen | |
| 2008/0254678 | A1 | 10/2008 | Amidon | |
| 2008/0274643 | A1 | 11/2008 | Chawgo | |
| 2009/0197465 | A1 | 8/2009 | Montena et al. | |
| 2009/0233482 | A1 | 9/2009 | Chawgo et al. | |
| 2009/0269979 | A1 | 10/2009 | Montena | |
| 2010/0261381 | A1 | 10/2010 | Montena et al. | |
| 2010/0261382 | A1 | 10/2010 | Montena et al. | |
| 2010/0273340 | A1 | 10/2010 | Clausen | |
| 2011/0008998 | A1 | 1/2011 | Low et al. | |
| 2011/0009000 | A1 | 1/2011 | Paynter | |
| 2011/0021074 | A1 | 1/2011 | Paynter et al. | |
| 2011/0244722 | A1 * | 10/2011 | Chawgo et al. | 439/578 |
| 2011/0263154 | A1 | 10/2011 | Chawgo et al. | |
| 2012/0088381 | A1 | 4/2012 | Wild et al. | |
| 2012/0088404 | A1 | 4/2012 | Wild et al. | |
| 2012/0088405 | A1 | 4/2012 | Wild et al. | |
| 2012/0088406 | A1 | 4/2012 | Montena et al. | |
| 2012/0088407 | A1 | 4/2012 | Natoli | |
| 2012/0102733 | A1 | 5/2012 | Wild | |
| 2012/0214338 | A1 | 8/2012 | Nugent | |
| 2012/0252265 | A1 | 10/2012 | Wild et al. | |

FOREIGN PATENT DOCUMENTS

| | | | |
|---|---|---|---|
| EP | 2190068 | A1 | 5/2010 |
| EP | 2219267 | B1 | 8/2010 |
| GB | 1203775 | A | 9/1970 |
| KR | 200351496 | Y1 | 5/2004 |
| WO | 2005004290 | A1 | 1/2005 |
| WO | 2007101435 | A1 | 9/2007 |

* cited by examiner

900

Date: 1/11/2012 SUMMITEK Time: 1:04 PM

Passive IM Test Results

*Description*

*Model Number*

*Serial Number*

*Operator*

*Carrier Sweep*

| *ALC is on* | *Measured Power* | *Offset* |
|---|---|---|
| F2 DOWN from 1990.0 to 1951.0 MHz. F1 Fixed at 1930.0 MHz | *20.3 Watt* | *1.0* |
| F1 UP from 1930.0 to 1950.0 MHz. F2 Fixed at 1990.0 MHz | *19.6 Watt* | *1.0* |

*Passive IM Response (IM3)*

F2 Down —— F1=1930.0 MHz, F2=1950.0 MHz; IM3=-159.7 dBc at 1910.0

F1 Up —⊟— F1=1950.0 MHz, F2=1990.0 MHz; IM3=-158.2 dBc at 1910.0

REVERSE IM

*Summitek Instruments VFP (v7.9.0030): SI-1900 H* *Rev. 7.9.0030*

PPC

901

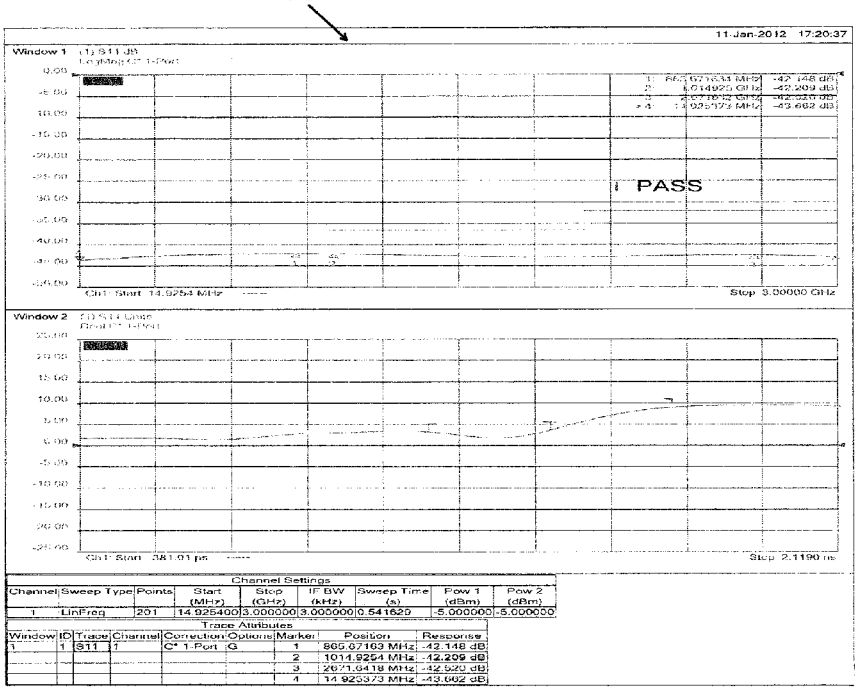

Channel Settings

| Channel | Sweep Type | Points | Start (MHz) | Stop (GHz) | IF BW (kHz) | Sweep Time (s) | Pow 1 (dBm) | Pow 2 (dBm) |
|---|---|---|---|---|---|---|---|---|
| 1 | LinFreq | 201 | 14.925400 | 3.000000 | 3.000000 | 0.541629 | -5.000000 | -5.000000 |

Trace Attributes

| Window | ID | Trace | Channel | Correction | Options | Marker | Position | Response |
|---|---|---|---|---|---|---|---|---|
| 1 | 1 | S11 | 1 | C* 1-Port | G | 1 | 865.07163 MHz | -42.148 dB |
| | | | | | | 2 | 1014.9254 MHz | -42.209 dB |
| | | | | | | 3 | 2671.9418 MHz | -42.520 dB |
| | | | | | | 4 | 14.925373 MHz | -43.662 dB |

SAMPLE #: _____ PLOT TYPE: GATED RL PLOT #: _____

PART #: _____ D/C: _____

CABLE: _____

ADAPTERS: _____

TESTED BY: _____ DATE: _____ TEST REQUEST: _____

NOTES: _____

TESTLAB01

PPC ENGINEERING TEST LAB

FORMS vsSRL-4L-Z

FIG. 7

CENTER CONDUCTOR ENGAGEMENT MECHANISM

CROSS-REFERENCE TO RELATED APPLICATIONS

This application claims priority to U.S. Provisional Application No. 61/585,871 filed Jan. 12, 2012, and entitled "CENTER CONDUCTOR ENGAGEMENT MECHANISM."

FIELD OF TECHNOLOGY

The following relates to coaxial cable connectors, and more specifically to embodiments of a center conductor engagement mechanism.

BACKGROUND

Coaxial cable is used to transmit radio frequency (RF) signals in various applications, such as connecting radio transmitters and receivers with their antennas, computer network connections, and distributing cable television signals. Coaxial cable typically includes a hollow center conductor, an insulating layer surrounding the center conductor, an outer conductor surrounding the insulating layer, and a protective jacket surrounding the outer conductor. A coaxial cable is typically attached to a prepared end of the coaxial cable to connect onto complementary interface ports, such as those on cellular towers and other broadband equipment. One of the difficulties of field-installable coaxial cable connectors, such as compression connectors or screw-together connectors, is maintaining acceptable levels of passive intermodulation (PIM) and return loss. PIM and return loss in the terminal sections of a coaxial cable can result from nonlinear and insecure contact between surfaces of various components of the connector. A nonlinear contact between two or more of these surfaces can cause micro arcing or corona discharge between the surfaces, which can result in the creation of interfering RF signals. Where the coaxial cable is employed on a cellular communications tower, for example, unacceptably high levels of PIM in terminal sections of the coaxial cable and resulting interfering RF signals can disrupt communication between sensitive receiver and transmitter equipment on the tower and lower-powered cellular devices. Disrupted communication can result in dropped calls or severely limited data rates, for example, which can result in dissatisfied customers and customer churn. Accordingly, engaging the hollow center conductor of the coaxial cable when a coaxial cable is attached to a connector is critical for desirable PIM results. The contact between a hollow center conductor and the receptive clamp engages the center conductor to provide a contact force therebetween. The result of poor engaging and/or seizing of the hollow center conductor leads to equally poor contact force between the center conductor and the clamp of the connector.

Thus, a need exists for an apparatus and method for a center conductor engagement mechanism that ensures an adequate contact force between a center conductor of a coaxial cable and a clamp of a coaxial cable connector.

SUMMARY

A first general aspect relates to a center conductor engagement member comprising a resilient contact region having a first end and a second end, the resilient contact region being substantially curvilinear from the first end to the second end, wherein the second end of the resilient contact region is secured by a body portion, and an insert engageable with the second end of the resilient contact region to retain the second end of the resilient contact region.

A second general aspect relates to a center conductor engagement member comprising a resilient contact region having one or more axial through-slots defining one or more resilient contact fingers, the one or more resilient contact fingers configured to compress when surrounded by a center conductor of a coaxial cable, wherein a largest radial outer diameter of the resilient contact region occurs at a vertex of a curve of the resilient contact region, an insert, the insert being a generally annular member having an internal groove, wherein the internal groove cooperates with a protrusion on an end of the one or more resilient contact fingers to resist movement of the one or more resilient contact fingers in a radial direction that results in a less than adequate return contact force against an inner surface of the center conductor.

A third general aspect relates to a coaxial cable connector comprising a center conductor engagement member disposed within the connector, the center conductor engagement member comprising a resilient contact region and an insert, wherein the coaxial cable connector achieves an intermodulation level below −155 dBc and return loss below −45 dB.

A fourth general aspect relates to a method of engaging a center conductor of a coaxial cable comprising disposing a center conductor engagement member within a coaxial cable connector, wherein the center conductor engagement member includes: a resilient contact region having a first end and a second end, the resilient contact region being substantially curvilinear from the first end to the second end, wherein the second end of the resilient contact region is secured by a body portion, and an insert engageable with the second end of the resilient contact region to retain the second end of the resilient contact region, and mating a center conductor of a coaxial cable with the center conductor engagement member, wherein the center conductor engagement member is configured to be inserted within the center conductor.

The foregoing and other features of construction and operation will be more readily understood and fully appreciated from the following detailed disclosure, taken in conjunction with accompanying drawings.

BRIEF DESCRIPTION OF THE DRAWINGS

Some of the embodiments will be described in detail, with reference to the following figures, wherein like designations denote like members, wherein:

FIG. 7 depicts a graph displaying data and test results regarding return loss performance of the first and second embodiments of the coaxial cable connector including an embodiment of the center conductor engagement member.

DETAILED DESCRIPTION

A detailed description of the hereinafter described embodiments of the disclosed apparatus and method are presented herein by way of exemplification and not limitation with reference to the Figures. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

Figure 1:
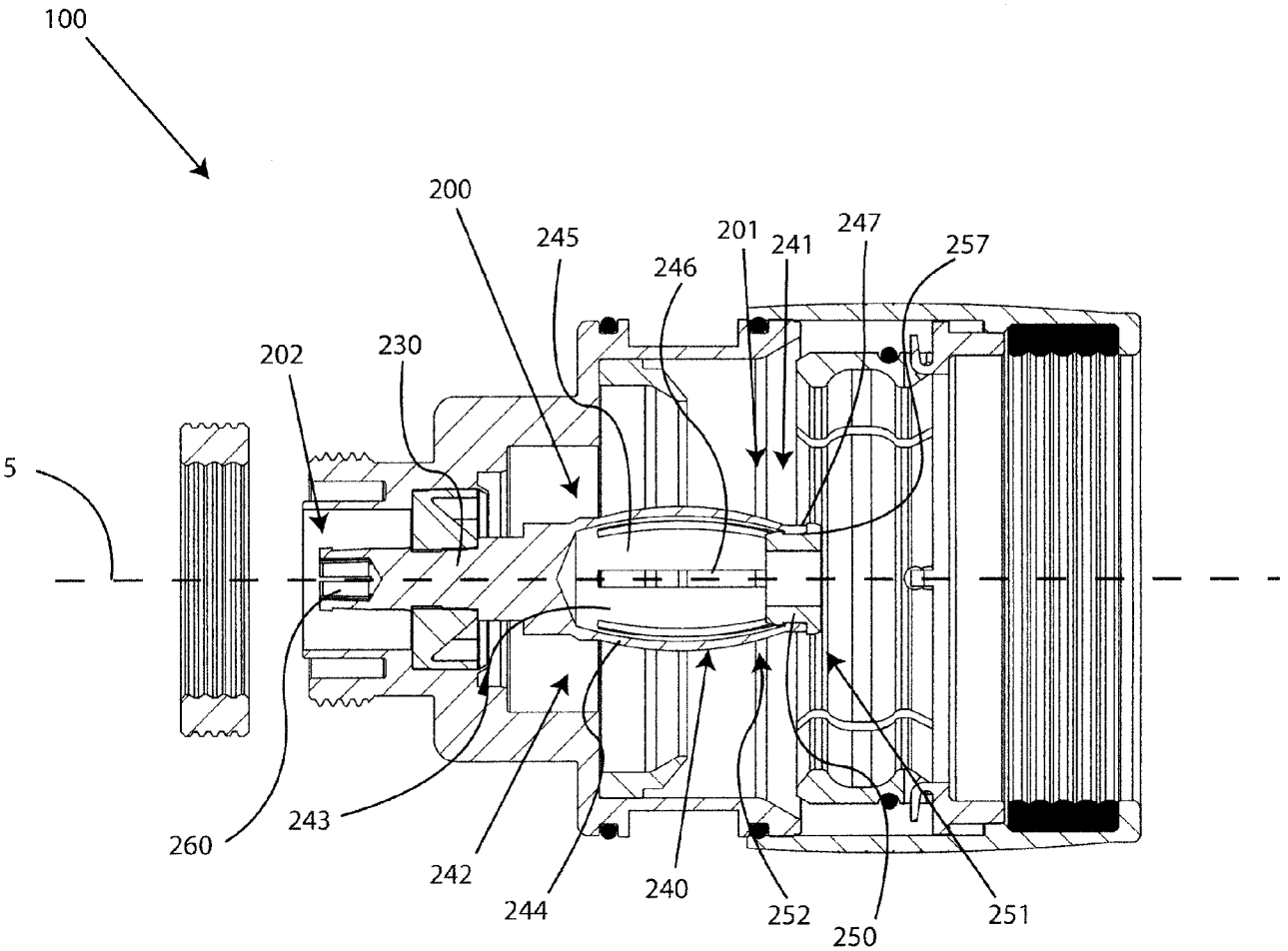
FIG. 1 depicts a cross-sectional view of an embodiment of a center conductor engagement member disposed within a first embodiment of a coaxial cable connector.
Figure 2:
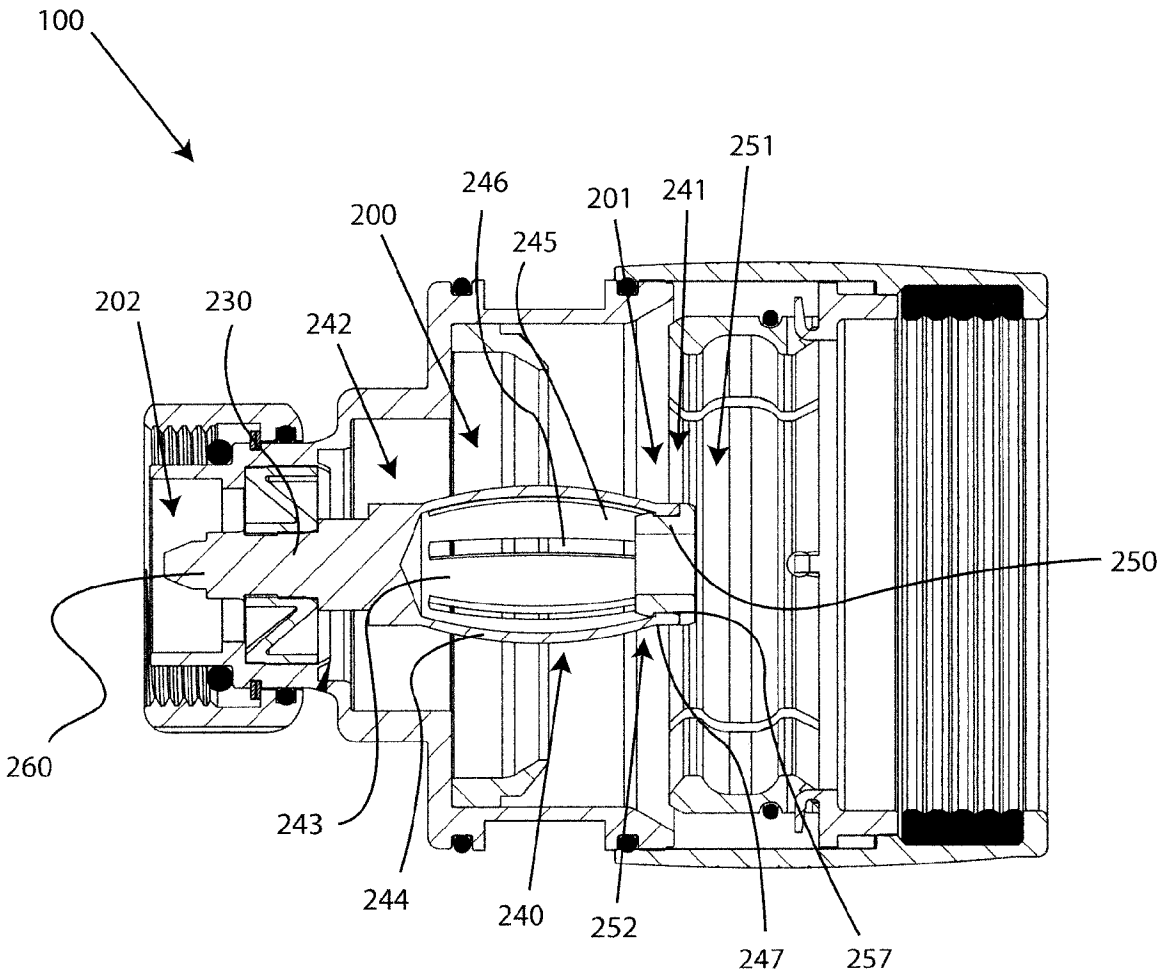
FIG. 2 depicts a cross-sectional view of an embodiment of a center conductor engagement member disposed within a second embodiment of a coaxial cable connector.

Referring to the drawings, FIG. 1 depicts an embodiment of a center conductor engagement member 200 disposed within a coaxial cable connector 100, wherein the center conductor engagement member 200 is configured to mate, accept, engage, seize, etc, a hollow center conductor 18 of a coaxial cable 10. Embodiments of the center conductor engagement member 200 may be a conductive element that may extend or carry an electrical current and/or signal from a first point to a second point. For instance, the center conductor engagement member 200 may be a contact, a terminal, a pin, a conductor, an electrical contact, a curved contact, a bended contact, an angled contact, and the like. In one embodiment, the center conductor engagement member 200 may be a contact for a 50 Ohm DIN female, 1⅝". In another embodiment, the center conductor engagement member 200 may be a contact for a 50 Ohm DIN male, 1⅝". Embodiments of the center conductor engagement member 200 may include a first end 201, a second end 202, an inner surface 203, and an outer surface 204. Embodiments of the center conductor engagement member 200 may further include a resilient contact region 240 proximate or otherwise near the first end 201, an external contact interface 260 proximate or otherwise near the second end 202, and a body portion 230 integrally connecting the resilient contact region 240 and the external contact interface 260. The external contact interface 260 may be a socket, a female contact, a male pin, or other physical device for establishing a physical and electrical connection with another coaxial cable connection, a splice connector, electronic device, and the like, and may be slotted. However, embodiments of the second end 202 may not include an external conductive interface 260 that can operate as a socket, but rather the second end 202 may include a pin-like end for use with a male type connector, as shown in FIG. 2. Furthermore, embodiments of the center conductor engagement member 200 should be formed of conductive materials; however, one or more of the components comprising the center conductor engagement member 200 may not be conductive, such as an insert 250, as described in greater detail infra.

Figure 3A:
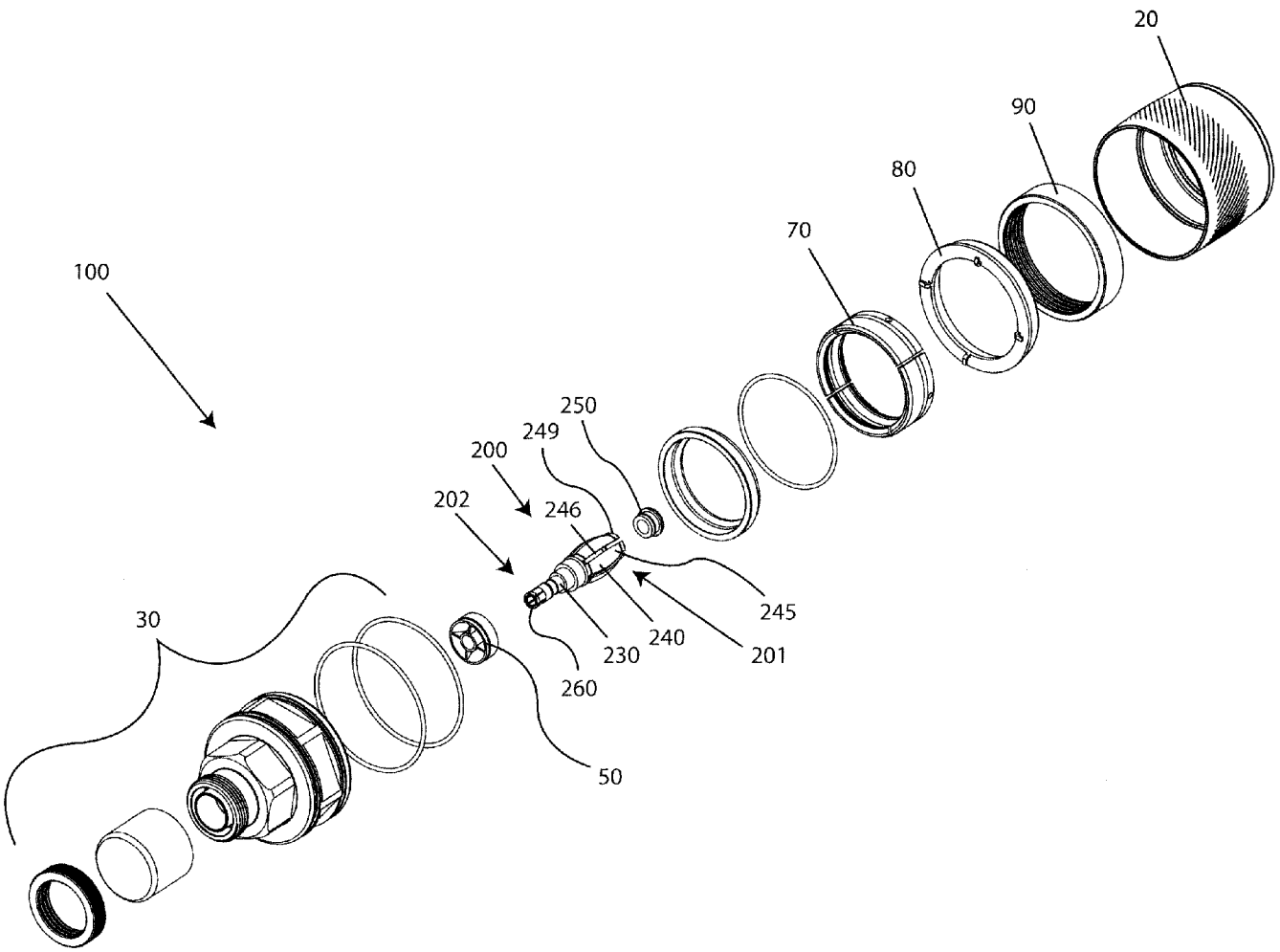
FIG. 3A depicts an exploded view of the first embodiment of the coaxial cable connector having an embodiment of the center conductor engagement member.
Figure 3B:
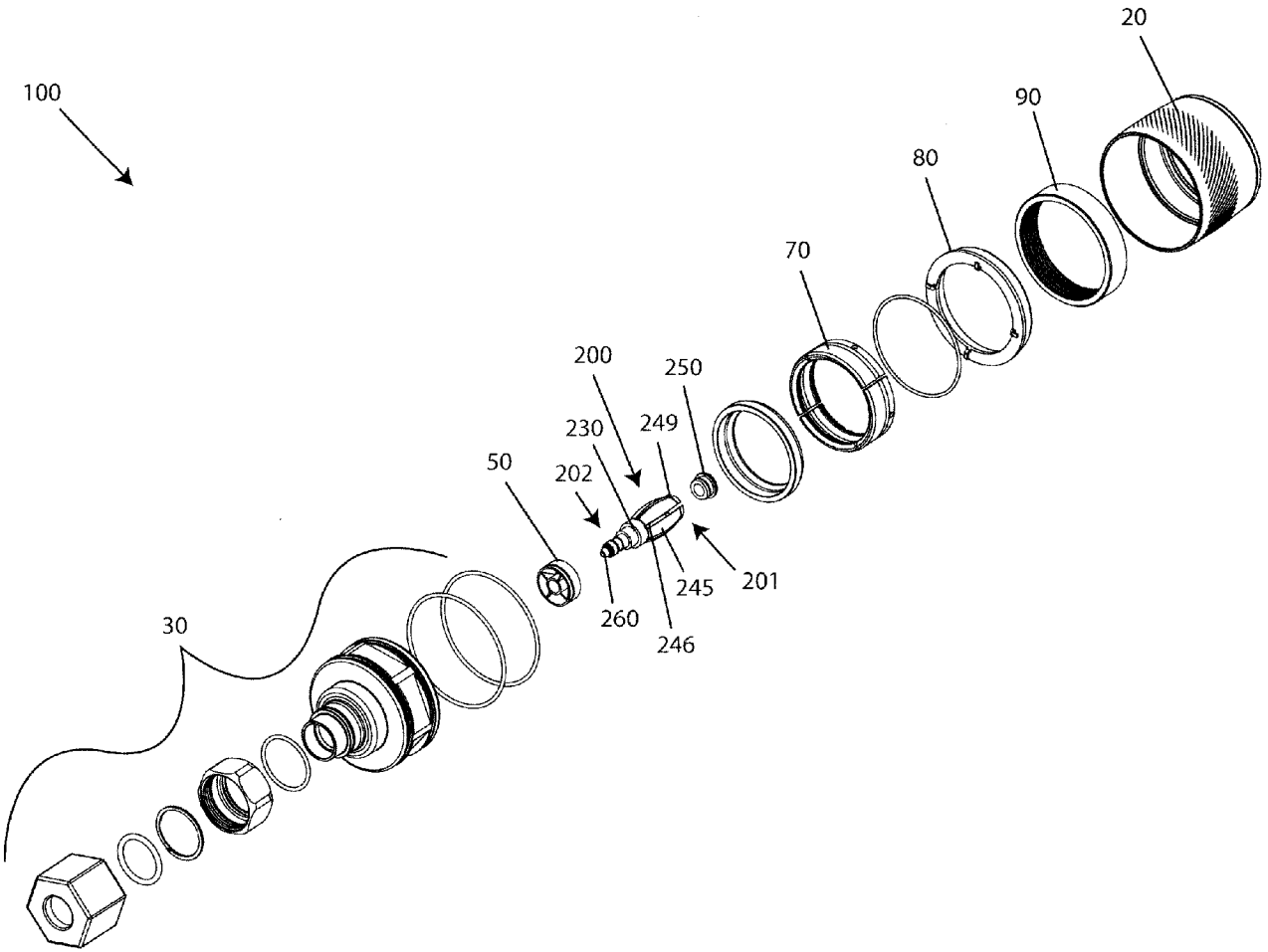
FIG. 3B depicts an exploded view of the second embodiments of the coaxial cable connector having an embodiment of the center conductor engagement member.

Referring now to FIGS. 3A and 3B, embodiments of connector 100, which may house the center conductor engagement member 200, may be a straight connector, a right angle connector, an angled connector, an elbow connector, a DIN male or DIN female connector, or any complimentary connector that may receive a center conductor 18 of a coaxial cable. For example, connector 100 may be a coaxial cable connector used for terminating coaxial cable, such as 50 Ohm cable. Further embodiments of connector 100 may receive a center conductor 18 of a coaxial cable 10, wherein the coaxial cable 10 includes a spiral, corrugated, annular ribbed, smooth wall, or otherwise exposed outer conductor 14. Moreover, embodiments of connector 100 can be a compression connector configured to be axially compressed (via an axial compression tool) into a compressed position of engagement with the cable 10. Embodiments of connector 100 may include a coupling member (not shown), a connector body 20, an insulator 50, a clamp 70, a flanged bushing 80, and an annular seal 90. The connector body 20 may comprise one, single component, or may be comprised of more than one component. The connector body 20 may house the center conductor engagement member 200, as well as the clamp 70, the annular seal 90, the flanged bushing 80, the insulator 50, and a coupling portion 30. Embodiments of the clamp 70 may be configured to clamp and/or seize the cable 10, including the outer conductor 14 and/or the cable jacket 12, as the connector 100 is initially attached to a prepared end of the cable 10. Embodiments of the annular seal 90 may be configured to compressibly deform upon axial compression to form an annular seal at a back end of the connector 100. Embodiments of the insulator 50 may electrically isolate the center conductor engagement member 200 and the outer conductor 14 and any component in conductive communication with the outer conductor 14. The insulator 50, which may be press fit within the connector body 20 may retain the center conductor engagement member 200 within the connector 100. Embodiments of the coupling portion 30 may be configured to physically mate or threadably engage a port, such an equipment port on a cell tower or other broadband equipment, or another coaxial cable connector. The coupling portion 30 may include a threaded exterior surface, such as shown in FIG. 3A, or may include a rotatable coupler that may include a threaded inner surface, such as shown in FIG. 3B. Those skilled in the art should appreciate that various structural configurations may be employed to retain the center conductor engagement member 200 within the connector 100, and that various connector components can be added, removed, or swapped from connector 100 as described herein.

The connector 100 may also be provided to a user in a preassembled configuration to ease handling and installation during use. Two connectors, such as connector 100 may be utilized to create a jumper that may be packaged and sold to a consumer. A jumper may be a coaxial cable 10 having a connector, such as connector 100, operably affixed at one end of the cable 10 where the cable 10 has been prepared, and another connector, such as connector 100, operably affixed at the other prepared end of the cable 10. Operably affixed to a prepared end of a cable 10 with respect to a jumper includes both an uncompressed/open position and a compressed/closed position of the connector while affixed to the cable. For example, embodiments of a jumper may include a first connector including components/features described in association with connector 100, and a second connector that may also include the components/features as described in association with connector 100, wherein the first connector is operably affixed to a first end of a coaxial cable 10, and the second connector is operably affixed to a second end of the coaxial cable 10. Embodiments of a jumper may include other components, such as one or more signal boosters, molded repeaters, and the like.

Figure 4A:
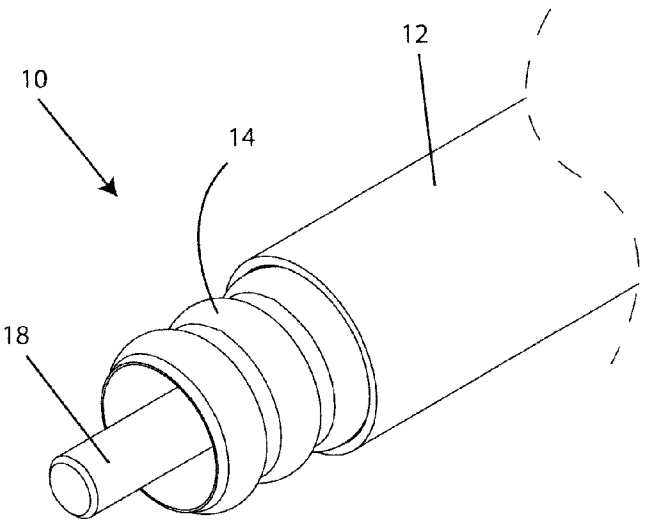
FIG. 4A depicts a perspective view of a first embodiment of a coaxial cable.
Figure 4B:
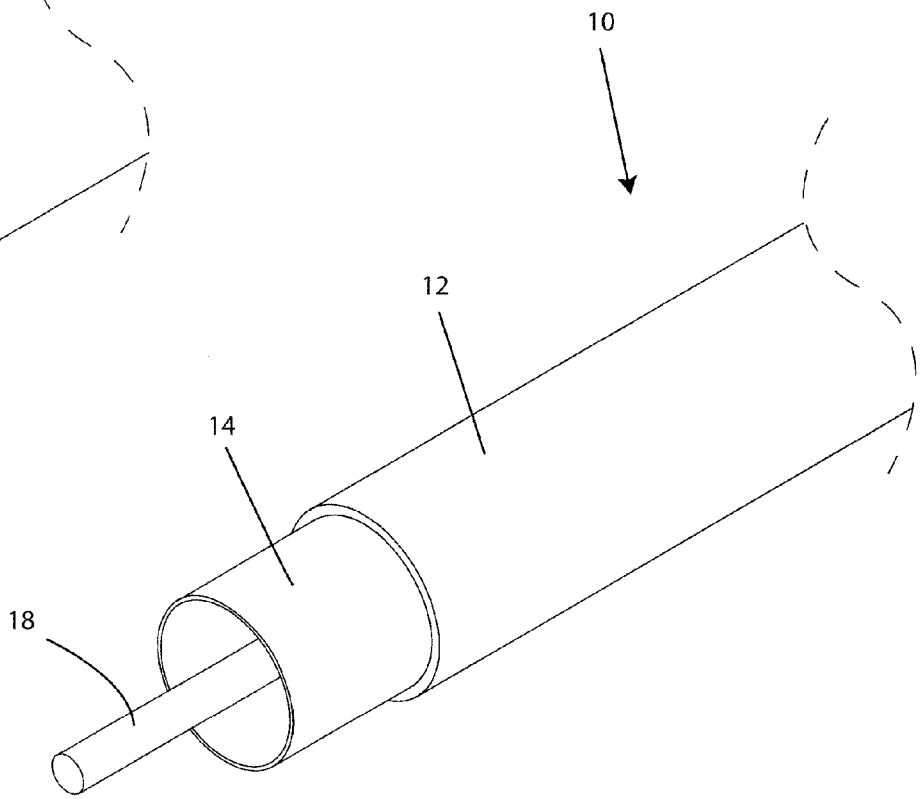
FIG. 4B depicts a perspective view of a second embodiment of the coaxial cable.

Referring to FIGS. 4A and 4B, embodiments of a coaxial cable 10 may be securely attached to a coaxial cable connector. The coaxial cable 10 may include a center conductor 18, such as a strand of conductive metallic material, surrounded by an interior dielectric 16; the interior dielectric 16 may possibly be surrounded by an outer conductor 14; the outer conductor 14 is surrounded by a protective outer jacket 12, wherein the protective outer jacket 12 has dielectric properties and serves as an insulator. The center conductor 18 may be hollow or tubular, such as a standard tubular center conductor associated with a standard 50 Ohm cable. Embodiments of the center conductor 18 may be smooth walled, or may have multiple corrugations. The outer conductor 14 may extend a grounding path providing an electromagnetic shield about the center conductor 18 of the coaxial cable 10. The outer conductor 14 may be a rigid or semi-rigid outer conductor of the coaxial cable 10 formed of conductive metallic material, and may be corrugated, or otherwise grooved, or smooth walled. For instance, the outer conductor 14 may be smooth walled, annularly ribbed, spiral corrugated, or helical corrugated. The coaxial cable 10 may be prepared by removing a portion of the protective outer jacket 12 so that a length of the outer conductor 14 may be exposed, and then coring out a portion of the dielectric 16 to create a cavity 15 or space between the outer conductor 14 (and potentially the jacket 12), and the center conductor 18. The protective outer jacket 12 can physically protect the various components of the coaxial cable 10 from damage that may result from exposure to dirt or moisture, and from corrosion. Moreover, the protective outer jacket 12 may serve in some measure to secure the various components of the coaxial cable 10 in a contained cable design that protects the cable 10 from damage related to movement during cable installation. The outer conductor 14 can be comprised of conductive materials suitable for carrying electromagnetic signals and/or providing an electrical ground connection or electrical path connection. Various embodiments of the outer conductor layer 14 may be employed to screen unwanted noise. The dielectric 16 may be comprised of materials suitable for electrical insulation. The protective outer jacket 12 may also be comprised of materials suitable for electrical insulation. It should be noted that the various materials of which all the various components of the coaxial cable 10 should have some degree of elasticity allowing the cable 10 to flex or bend in accordance with traditional broadband communications standards, installation methods and/or equipment. It should further be recognized that the radial thickness of the coaxial cable 10, protective outer jacket 12, outer conductor 14, interior dielectric 16, and/or center conductor 18 may vary based upon generally recognized parameters corresponding to broadband communication standards and/or equipment.

Referring back to FIG. 1, and with additional reference to FIGS. 2-3B, embodiments of a center conductor engagement member 200 may include a resilient contact region 240 proximate the first end 201, the resilient contact region 240 configured to be compressed when inserted into a hollow center conductor 18. Embodiments of the resilient contact region 240 may include a first end 241, a second end 242, an inner surface 243, and an outer surface 244. The resilient contact region 240 may be slotted to facilitate compression and/or deflection when surrounded by the center conductor 18 in a second, closed position. A slotted configuration of the resilient contact region may be effectuated by the presence of one or more axial through-slots 246. Embodiments of the resilient contact region 240 having one or more axial slots 246 may include one or more resilient contact finger 245. For example, embodiments of the center conductor engagement member 200 may include a plurality of resilient contact fingers 245 proximate the first end 201. Those having skill in the art should appreciate that various slotted configurations may be employed to facilitate compression and/or deflection of the resilient contact fingers 245. The amount of slots 246, the length of the slots 246, and width of the axial slots 246 may be increased or decreased to increase or decrease the number and width of contact fingers 245, respectively, which can have an impact on the deflection, stiffness, tunability, machinability (e.g. thickness of fingers 245, length of slots 246, width of slots 246, etc.), and damage resistance of the contact fingers 245 when the center conductor 18 is inserted over the resilient contact region 240 of the center conductor engagement member 200, and during transport and assembly. For example, one or more slots 246 may begin proximate the first end 241 of the resilient contact region 240, but may not extend completely across the resilient contact region 240 to the second end 242, while one or more slots 246 may begin from the second end 242 and may not extend completely across to the first end 241; this arrangement may alternate around the resilient contact region 240. Further, the resilient contact fingers 245 may extend from a body 230 of the center conductor engagement member 200. Embodiments of the resilient contact fingers 245, in particular, the second end 242 of the resilient contact region 240 may be structurally integral with the body portion 230. For example, the second end 242 of the resilient contact region may be retained, secured, captured, etc., by the body 230 of the center conductor engagement member 200.

Moreover, the plurality of resilient contact fingers 245 may arc from the body 230 of the center conductor engagement member 200 until retained by an insert 250. Embodiments of the resilient contact region 240 may be curvilinear or substantially curvilinear from the first end 241 to the second end 242. Embodiments of the resilient contact region 240 may also be continuously curvilinear or continuously substantially curvilinear from the second end 242 proximate the body portion 230 to an internal annular protrusion 247. Further, embodiments of the resilient contact region 240 may have a slotted oblong-like or elliptical-like shape, wherein a largest radial outer diameter of the resilient contact region 240 may occur at the vertex of the curve of the resilient contact region 240. The substantially arced, curved, curvilinear, etc., shape of the resilient contact region 240 (and each of the plurality of resilient contact fingers 245) may facilitate compression and/or deflection of the resilient contact region 240, when the center conductor 18 is in the second, closed position. The substantially arced or curved resilient contact region 240 may also assist the initial physical mating and timing of the mating of the center conductor 18 and resilient contact region 240 because of the gradual increase in radial diameter of the resilient contact region 240. The distal end of the resilient contact fingers 245 may include an internal annular protrusion 247, wherein the distal end of the resilient contact fingers 245 can coincide with the first end 241 of the resilient contact region 240; an annular groove 249 may be located on the outer surface 203 proximate the location of the internal annular protrusion 247. Embodiments of the internal annular protrusion 247 may be a portion at the end of each resilient contact finger 245 that extends or protrudes a distance from the inner surface 203, 243 towards a central axis 5 of the center conductor engagement member 200. The internal annular protrusion 247 may be configured to cooperate with an annular groove 257 of the insert 250. For instance, the internal annular protrusion 247 may snap into the groove 257 of the insert 250 to secure, retain, capture, etc., the first end 241 of the resilient contact region 240 of the center conductor engagement member 200. Thus, the resilient contact region 240 of the center conductor engagement member 200 may be engageable with the insert 250; the first end 241 of the resilient contact region may be securably retained within the annular groove 257 of the insert 250, while the second 242 may be integrally retained by the body portion 230.

Referring still to FIGS. 1-3B, embodiments of the center conductor engagement member 200 may include an insert 250 configured to retain or capture a first end 241 of the resilient contact region 240. Embodiments of the insert 250 may have a first end 251 and a second end 252, and may be a generally annular member having a generally axial opening therethrough. Moreover, embodiments of the insert 250 may include an annular groove 257 configured to accept an internal annular protrusion 247 on the resilient contact finger 245. The annular groove 257 may be sized and dimensioned to receive the internal annular protrusion 247 of the contact finger 245, and may be located between the first end 251 and the second end 252. However, the wall of the annular groove 257 proximate or otherwise near the second end 252 may be raised or extend radially outward slightly more than the wall of the annular groove 257 proximate or otherwise near the first end 251 of the insert 250 for retention purposes. Embodiments of the insert 250 may be conductive, for example, comprised of a metal or a combination of metal, or embodiments of the insert 250 may be non-conductive, for example, comprised of a rubber or plastic, for cost control. Moreover, an elastomeric band or rubber band may be placed within the annular groove 257 of the insert 250 to adjust the stiffness of the resilient contact region 240. Embodiments of the insert 250 may be comprised of elastic rubber material(s) instead of metal or plastic to reduce the stiffness of the resilient contact region 240.

Figure 5:
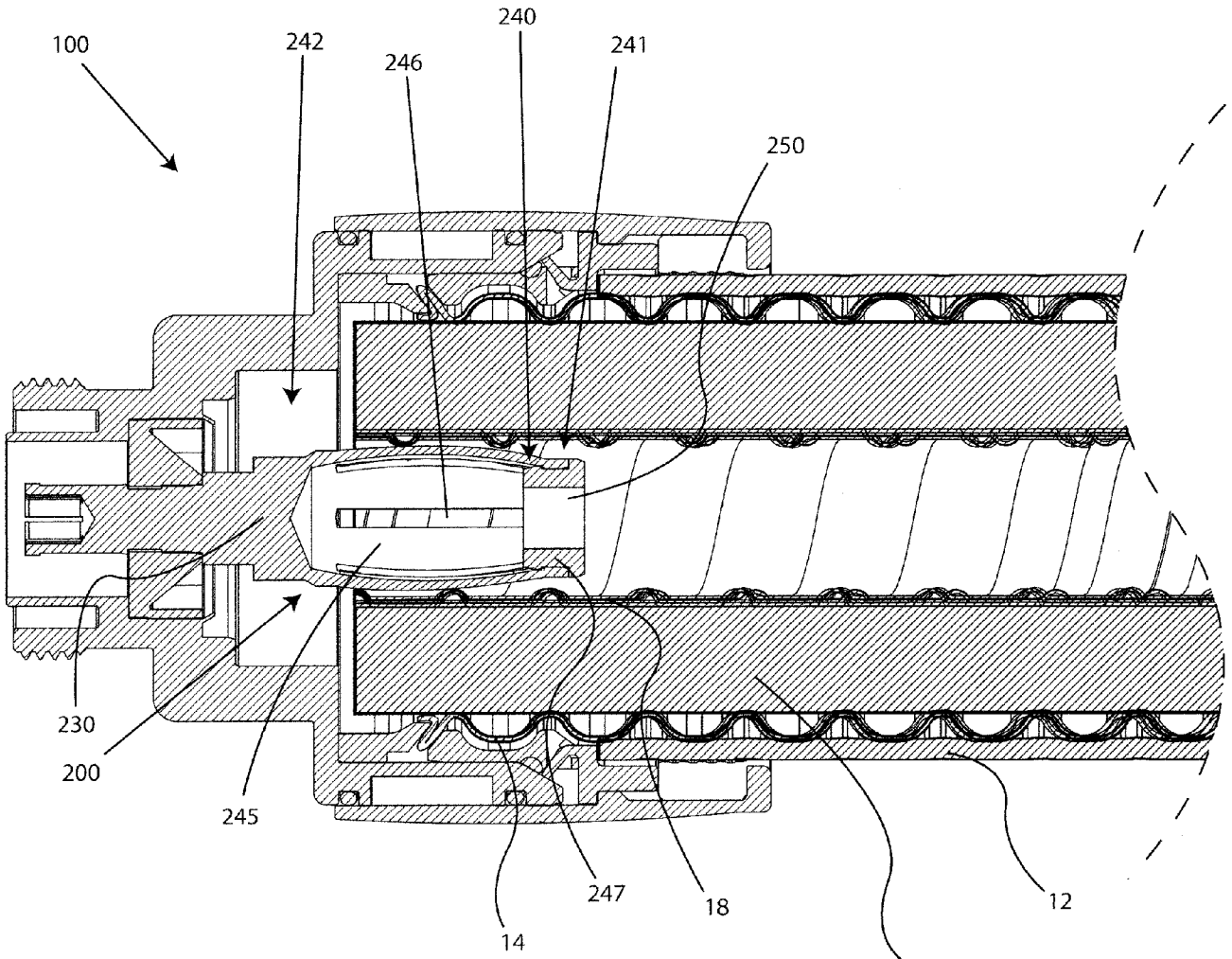
FIG. 5 depicts a cross-sectional view of an embodiment of the center conductor engagement member disposed within an embodiment of the connector, in a second, closed position.

Embodiments of the annular groove 257 of the insert 250 may prevent movement of the resilient contact fingers 245 in an axial and/or radial direction that results in less than adequate return contact force against the inner surface of the hollow center conductor 18, when the resilient contact region 240 is compressed as the hollow center conductor 18 passes over the resilient contact region 240. For example, as the cable 10 is being inserted within the connector 100, the center conductor is configured to mate with the center conductor engagement member 200, as shown in FIG. 1. Continued advancement of the cable 10 within the connector 100 mates the center conductor 18 and the center conductor engagement member 200. During mating of the center conductor 18 and the center conductor engagement member 200, the resilient contact region 240 of the center conductor engagement member 200 enters the hollow, tubular opening of the center conductor 18. Because the largest outer diameter of the resilient contact region 240 may be slightly larger than the inner diameter of the hollow opening of the center conductor 18, the center conductor 18 can exert a compressive force onto the resilient contact region 240 to axially and/or radially compress the resilient contact fingers 245. Thus, the resilient contact fingers 245 may slightly move or flatten (e.g. in a radially inward or axially expansive direction) once the center conductor 18 is mated with the center conductor engagement member 200; however, the insert 250 may prevent movement of the resilient contact fingers 245 that results in a less than adequate return contact force against the inner surface of the hollow center conductor 18. Specifically, the insert 250 may prevent, or hinder over-compression, or excess deflection of the resilient contact fingers 245 such that cantilever-type deflection of the resilient contact fingers 245 is greatly minimized to ensure stiff, firm physical contact against the inner surface of the center conductor 18, as shown in FIG. 5. In other words, only a slight deflection of the resilient contact fingers 245, or significant non-movement of the resilient contact fingers 245, is achieved because of the insert 250 operably attached to the first end 241 of the resilient contact region 240, wherein only a slight deflection can ensure a firm return force exerted by the deflected resilient contact fingers 245 against the center conductor 18 in the opposite direction of the compressive force exerted by the center conductor 18 against the resilient contact region 240. The insert 250 operably attached to the resilient contact region 240 can provide for stiffness of the resilient contact fingers 245 while also ensuring adequate contact force with the hollow center conductor 18. Accordingly, the resilient contact region 240 of the center conductor engagement member 200 may be secured, retained, retainably secured, securably retained, captured, and the like, at both the first end 241 and the second 242. The center conductor engagement member 200 may then make good electrical contact on a large diameter range.

Figure 6:
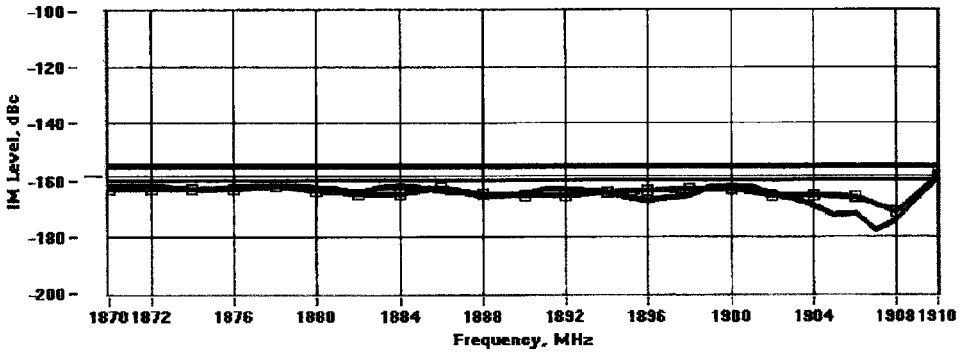
FIG. 6 depicts a graph displaying data and test results regarding PIM performance of the first and second embodiments of the coaxial cable connector including an embodiment of the center conductor engagement member.

FIG. 6 discloses a chart 900 showing the results of PIM testing performed on the coaxial cable 10 that was terminated using the example compression connector 100 having a center conductor engagement member 200. The particular test used is known to those having skill in the requisite art as the International Electrotechnical Commission (IEC) Rotational Test. The PIM testing that produced the results in the chart was also performed under dynamic conditions with impulses and vibrations applied to the example compression connector 100 during the testing. As disclosed in the chart, the PIM levels of the example compression connector, 100 were measured on signals F1 UP and F2 DOWN to vary significantly less across frequencies 1870-1910 MHz. Further, the PIM levels of the example compression connector 100 remained well below the minimum acceptable industry standard of −155 dBc. For example, F1 UP achieved an intermodulation (IM) level of −158.2 dBc at 1910 MHz, while F2 DOWN achieved an intermodulation (IM) level of −159.7 dBc at 1910 MHz. These superior PIM levels of the example compression connector 100 having a center conductor engagement member 200 are due at least in part to the engagement of the center conductor 18 by the center conductor engagement member 200 when the connector 100 in the closed position, as described supra.

Compression connectors having PIM levels above this minimum acceptable standard of −155 dBc result in interfering RF signals that disrupt communication between sensitive receiver and transmitter equipment on the tower and lower-powered cellular devices in 4G systems. Advantageously, the relatively low PIM levels achieved using the example compression connector 100 surpass the minimum acceptable level of −155 dBc, thus reducing these interfering RF signals. Accordingly, the example field-installable compression connector 100 having a center conductor engagement member 200 enables coaxial cable technicians to perform terminations of coaxial cable in the field that have sufficiently low levels of PIM to enable reliable 4G wireless communication. Advantageously, the example field-installable compression connector 100 having a center conductor engagement member 200 exhibits impedance matching and PIM characteristics that match or exceed the corresponding characteristics of less convenient factory-installed soldered or welded connectors on pre-fabricated jumper cables. Accordingly, embodiments of connector 100 may be a compression connector, wherein the compression connector achieves an intermodulation level below −155 dBc over a frequency of 1870 MHz to 1910 MHz.

FIG. 7 discloses a chart 901, corresponding graphical depictions, and associated data showing the results of "return loss" testing and impedance testing performed on the coaxial cable 10 that was terminated using the example compression connector 100 having a center conductor engagement member 200. Return loss as shown in FIG. 7 is expressed in −dB and reflects the ratio of the power of the reflected signal vs. the power of the incident signal. Thus, return loss, as measured, indicates how perfectly or imperfectly the coaxial cable line is terminated. The particular test was conducted according to the standards set by the International Electrotechnical Commission (IEC) and known to those having ordinary skill in the requisite art. The return loss testing that produced the results in the chart was also performed under dynamic conditions with impulses and vibrations applied to the example compression connector 100 during the testing. As disclosed in the graph of FIG. 7, Window 1 displays a graph of the measured return loss over frequencies ranging from 14.925 MHz to 3,000 GHz. Window 1 also discloses a graduated limit 400 that graduates depending on a frequency range. The return loss at a specific frequency should not be less than the graduated limit 400 set for the frequency range. As disclosed in FIG. 7, the chart lists four markers (4, 1, 2, 3—left to right) that denote the measured ratio of the return loss at a specific frequency. As depicted in FIG. 7, at 14.025 MHz (marker 4; the start) the return loss measured −43.66 dB, and over the range the frequency range between 14.025 MHz and 869.07 MHz, the return loss measured less than −45 dB, at 869.07 MHz (marker 1) the return loss measured −42.148 dB and over the frequency range between 869.07 MHz and 1.014 GHZ the return loss measured less than −45 dB. At 1.014 GHz (marker 2) the return loss measured −42.209 dB and over the frequency range between 1.014 GHz and 2.671 GHz the return loss measured less than −43.000 dB. At 2.671 GHz the return loss measured −42.520 dB. These superior return loss measurements of the example compression connector 100 are due at least in part to the center conductor engagement member 200, as described supra.

Compression connectors having return loss greater than the graduated limits associated with specific frequency ranges indicated in FIG. 7 result in interfering RF signals that disrupt communication between sensitive receiver and transmitter equipment; for example the connectors on cell towers and lower-powered cellular devices in 4G and 5G systems. Advantageously, the return loss measurements achieved using the example compression connector 100 are well below the graduated limits associated with specific frequency ranges indicated in FIG. 7, thus reducing these interfering RF signals. Accordingly, the example field-installable compression connector 100 enables coaxial cable technicians to perform terminations of coaxial cable in the field that have advantageous ratios of return loss to enable reliable 4G and 5G wireless communication. Advantageously, the example field-installable compression connector 100 exhibits return loss characteristics that match or exceed the corresponding characteristics of less convenient factory-installed soldered or welded connectors on pre-fabricated jumper cables. Accordingly, embodiments of connector 100 may be a compression connector, wherein the compression connector achieves return loss ratios below acceptable levels of return loss set by the graduated limits associated with specific frequency ranges indicated in FIG. 7.

As further depicted in FIG. 7, Window 2 graphically depicts an impedance plot showing deviation of impedance. The two flag-like designators mark the limits of the gate and are associated with the condition of the test signal as it particularly passed through the tested embodiment of the connector 100. It is notable that the deviation of the impedance within the gate section is minimal, as shown by the fairly flat deviation line running with only marginal variance above and below the zero-point (0.00). This minimal deviation depicted in Window 2 of FIG. 8 indicates that the performance of the connector 100 is not significantly impaired or burdened by substantial impedance problems, even while the signal travels through the connector along a right-angle path. Hence, the data and graphical depictions of the charts shown in FIG. 7 work to validate the functional performance of the connector 100, in having minimal impedance deviation, acceptable return loss levels, and minimized signal impact associated with passive intermodulation.

Referring now to FIGS. 1-5, a method of engaging a center conductor 18 of a coaxial cable 10 may include the steps of disposing a center conductor engagement member 200 within a coaxial cable connector 100, wherein the center conductor engagement member 200 includes a resilient contact region 240 having a first end 241 and a second end 242, the resilient contact region 240 being substantially curvilinear from the first end 241 to the second end 242, wherein the second end 242 of the resilient contact region 240 is secured by a body portion 230, and an insert 250 engageable with the second end 242 of the resilient contact region 240 to retain the second end 242 of the resilient contact region 240, and mating a center conductor 18 of a coaxial cable 10 with the center conductor engagement member 200, wherein the center conductor engagement member 200 is configured to be inserted within the center conductor 18.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the invention, as required by the following claims. The claims provide the scope of the coverage of the invention and should not be limited to the specific examples provided herein.

What is claimed is:

1. A center conductor engagement member comprising:

a body;

a resilient contact region having a first end and a second end integral with the body, the resilient contact region being substantially curvilinear from the first end to the second end; and a non-conductive insert configured to engage the first end of the resilient region and resist radial inward displacement thereof;

wherein the contact region arcs from the insert to the body and defines a curved external surface configured to engage an internal surface of a coaxial cable conductor.

2. The center conductor seizing member of claim 1, wherein the resilient contact region includes a plurality of resilient contact fingers.

3. The center conductor seizing member of claim 2, wherein the insert includes an annular groove configured to accept an internal annular protrusion located on an inner surface of the resilient contact fingers.

4. The center conductor seizing member of claim 1, wherein the insert ensures adequate contact force between a hollow center conductor and the resilient contact region.

5. The center conductor seizing member of claim 1, further including an external contact interface at an end distal to the resilient contact region.

6. The center conductor seizing member of claim 5, wherein the body portion connects the resilient contact region and the external contact interface.

7. The center conductor engagement member of claim 1, wherein the insert is comprised of at least one of a conductive and non-conductive material.

8. The center conductor engagement member of claim 3, further including an elastomeric band placed within the annular groove of the insert to adjust a stiffness of the resilient contact region.

9. The center conductor engagement member of claim 7, wherein a coaxial cable connector having the center conductor engagement member achieves an intermodulation level below −155 dBc and return loss below −45 dB.

10. A center conductor engagement member comprising:

a resilient contact region having a substantially curvilinear contour from a first end to a second end, the second end of the resilient contact region being integral with a body portion, the resilient contact region having one or more axial through-slots defining a plurality of resilient contact fingers, each of the plurality of resilient contact fingers being radially biased inwardly and defining an outwardly-curved external surface configured to engage an internal surface of a cable conductor the outwardly-curved external surface defining an outer diameter which is a maximum at a vertex of the outwardly-curved external surface; and a non-conductive annular insert having an internal groove cooperating with a protrusion on an end of each resilient contact finger, the annular insert resisting movement of the plurality of resilient contact fingers in a radial inward direction, the insert resisting radial inward displacement of the contact region to maintain contact of the external surface with the cable conductor.

11. The center conductor engagement member of claim 10, wherein the insert is comprised of at least one of a conductive and non-conductive material.

12. The center conductor engagement member of claim 10, wherein the insert is a plastic ring.

13. The center conductor engagement member of claim 10, further including an elastomeric band placed within the annular groove of the insert to adjust a stiffness of the resilient contact region.

14. The center conductor engagement member of claim 10, wherein a coaxial cable connector having the center conductor engagement member achieves an intermodulation level below −155 dBc and return loss below −45 dB.

15. A method of engaging a center conductor of a coaxial cable comprising: disposing a center conductor engagement member within a coaxial cable connector, wherein the center conductor engagement member includes a resilient contact region having a first end and a second end, the resilient contact region configured to produce a substantially curvilinear external surface which arcs from the first end to the second end, wherein the second end of the resilient contact region is integral with a body portion, and a non-conductive insert engageable with the first end of the resilient contact region to retain the second end of the resilient contact region; and mating a center conductor of a coaxial cable with the center conductor engagement member, wherein the contact region is biased inwardly against the insert and wherein the substantially curvilinear external surface of the center conductor engagement member is configured to be inserted within, and engage an inner surface of, the center conductor, the insert resisting radial inward displacement of the contact region to maintain contact of the external surface with the cable conductor.

16. The method of claim 15, wherein the resilient contact region includes a plurality of resilient contact fingers.

17. The method of claim 15, wherein the insert includes an annular groove configured to accept an internal annular protrusion located on an inner surface of the resilient contact fingers.

18. The method of claim 15, wherein the insert ensures adequate contact force between a hollow center conductor and the resilient contact region.

19. The method of claim 15, further including an external contact interface at an end distal to the resilient contact region.

* * * * *